United States Patent [19]

Kube

[11] 3,953,073

[45] Apr. 27, 1976

[54] PROCESS FOR THE SOLUTION MINING OF SUBTERRANEAN SODIUM BICARBONATE BEARING ORE BODIES

[76] Inventor: Wolfram H. Kube, 4093 S. Rosemary Way, Denver, Colo. 80237

[22] Filed: May 17, 1974

[21] Appl. No.: 470,912

[52] U.S. Cl. ..... 299/5; 23/272 AH; 423/206 T

[51] Int. Cl.[2] ..... E21B 43/28

[58] Field of Search ..... 299/4, 5; 423/206 T; 23/272 AH; 159/DIG. 13

[56] References Cited

UNITED STATES PATENTS 2,625,384 1/1953 Pike et al. ..... 299/5

3,184,287 5/1965 Gancy ..... 423/206 T

*Primary Examiner*—Stephen J. Novosad
*Assistant Examiner*—George A. Suckfield
*Attorney, Agent, or Firm*—Edwin L. Spangler, Jr.

[57] ABSTRACT

This invention relates to the solution mining of subterranean trona deposits which comprises treating the ore "in situ" with an aqueous solvent containing sodium hydroxide at a concentration of not less than approximately 1% and no greater than that which will leave the brine thus produced with no less than approximately 1.5 parts of sodium bicarbonate per hundred parts of sodium carbonate when saturated.

3 Claims, 6 Drawing Figures

NaOH is produced from $Na_2CO_3$ by caustification. Percent figures represent $Na_2CO_3$ equivalent of saturated solutions.

NaOH is produced from $Na_2CO_3$ by caustification. Percent figures represent $Na_2CO_3$ equivalent of saturated solutions.

PROCESS FOR THE SOLUTION MINING OF SUBTERRANEAN SODIUM BICARBONATE BEARING ORE BODIES

Solution mining of "in situ" mineral formations is an old technique that has been successfully used for many years. The recovery of halite from salt domes and sulfur from bore holes by the Frasch process provide some of the best examples of the technique. Some success has even been achieved in the solution mining of potassium chloride. Despite these successes with other minerals, the prior art attempts at recovering sodium carbonate by solution mining of subterranean formations containing substantial quantities of sodium bicarbonate have proven uneconomical due to the low yields.

Subterranean sodium carbonate deposits vary in composition from one location to another as might be expected, however, the major commercially developable deposits generally have one of three basic compositions. The first of these is the mineral "nahcolite" which is almost pure sodium bicarbonate in its natural state. Of the three, nahcolite is the least soluble in water.

The second of the naturally-occuring sodium bicarbonate minerals in terms of its water solubility is known as "wegscheiderite". This substance contains 29.6% $Na_2CO_3$ and 70.4% $NaHCO_3$ by weight in the form of three molecules of $NaHCO_3$ for each molecule of $Na_2CO_3$ as follows: $Na_2CO_3.3NaHCO_3$ The last of the three, and probably the most important from a commercial standpoint here in the United States at least due to the tremendous deposits in the State of Wyoming, is the naturally-occurring mineral called "trona" which is a sodium carbonate - sodium bicarbonate double salt having the formula $Na_2CO_3.NaHCO_3.2H_2O$. It contains 46.9% $Na_2CO_3$, 37.2% $NaHCO_3$ and 15.9% $H_2O$. While trona is more soluble than the other two in water at room temperature, it is still of relatively low solubility when compared with other naturally-occurring minerals mined "in situ" with solution mining techniques.

Unfortunately, the problem is not merely one of low solubility. Instead, it is one of severe solubility suppression resulting, at least in part, from a clogging of the dissolving face by sodium bicarbonate. The FMC Corporation has pioneered previous attempts at the solution mining of trona in the Wyoming field near Green River with little success and the basic problem it encountered has been delineated in the statement made by one of its engineers, Eric Rau by name, which is quoted below and which appeared at page 464 in KIRK-OTHMER; Encyclopedia of Chemical Technology, 2nd Vol., 1968:

> "Solution mining of the trona deposits has also been proposed. The process is not as simple as is the case with solution-mining of halite because of the complex solubility relationships in the system containing sodium sesquicarbonate and sodium bicarbonate. The latter tends to precipitate from dissolved trona and clog the dissolving face." (emphasis added)

It can be shown that the aforementioned problem arises because when trona, for example, is dissolved in water, both the sodium bicarbonate and the sodium carbonate fractions begin going into solution at the same time until the solution reaches saturation with respect to sodium bicarbonate. Unfortunately, the resulting liquid phase-solid phase system existing at this point is not in equilibrium and the sodium carbonate continues to dissolve while the bicarbonate starts precipitating out until an eventual equilibrium condition is, in fact, reached wherein a substantial portion of bicarbonate has come back out of solution and a good deal more of the carbonate has gone into solution. Wegscheiderite behaves in much the same way as trona in that they both go into solution in accordance with their respective solid percentage compositions of sodium bicarbonate and sodium carbonate, however, more sodium carbonate wants to go into solution and, because of this, it causes part of the sodium bicarbonate to precipitate back out. The resulting equilibrium condition is one in which substantially more sodium carbonate and a good deal less sodium bicarbonate exists in the solution phase than was present in the original solid phase mineral composition. It is this phenomena of the unstable nature of both trona and wegscheiderite in solution in the presence of the solid phase minerals that is responsible for the clogging problem. More specifically, the sodium bicarbonate that precipitates out does so upon the surrounding formation thus producing a barrier that inhibits the solvent action of the water upon the more soluble sodium carbonate trapped and sealed therebehind. The net result of this phenomenon is to progressively change the effective composition of the formation upon which the solvent acts until it appears to be made up of sodium bicarbonate alone. In other words, as more and more of the sodium bicarbonate precipitates out, it seals off the interstices through which the solvent can gain access to the sodium carbonate in the formation thereby permitting the solvent to act upon successively smaller amounts of sodium carbonate until about all the solvent can reach is the barrier itself. As previously stated, both of the naturally-occurring sodium bicarbonate-bearing minerals that include sodium carbonate, namely, wegscheiderite and trona, behave in the same way with nahcolite being the only exception due to the fact that it is essentially free of carbonate.

It has now been found in accordance with the teaching of the instant invention that these and other difficulties associated with the prior art attempts to solution mine naturally-occurring sodium bicarbonate deposits can be eliminated by the simple, yet unobvious, expedient of first converting a minimum amount of the sodium bicarbonate to sodium carbonate. This is conveniently accomplished by means of an aqueous sodium hydroxide solvent. It is of equal importance to adjust the sodium hydroxide concentration to the solvent temperature in order to prevent the precipitation of sodium bicarbonate. While the basic problem of nahcolite precipitation from the double salts can be eliminated by addition of a minimum amount of sodium hydroxide, only a comparatively small amount of ore will be dissolved which, of course, may be uneconomical. Accordingly, by adding more sodium hydroxide a higher yield of dissolved solids can be realized. On the other hand, the sodium hydroxide content of the solvent must not exceed a certain concentration to achieve the maximum yield at any given temperature. This maximum yield is obtained by adding the stoichiometrical amount of NaOH which is required to convert all of the sodium bicarbonate which can go into solution into sodium carbonate. Exceeding this maximum means that unreacted NaOH is left in solution which will inhibit the solubility of the sodium minerals or of sodium carbonate derived from them.

From an economical standpoint, the process is advantageous in that the caustic soda (NaOH) used in the reaction can frequently be manufactured at or near the site of the mine from sodium chloride which is often present with these same bicarbonate minerals. To do so depends upon the availability of inexpensive electric power because NaCl is converted to NaOH by electrolysis in accordance with the well-known process.

Alternatively, the NaOH can be produced by the caustification of soda ash with hydrated lime. If the latter process is used, both the lime and soda ash can be recycled. In any event, regardless of the process used to make the caustic soda, the economics of the process are most attractive.

There remain, of course, the obvious advantages inherent in any solution mining process, namely, such things as no overburden to remove and replace, minimal environmental impact, and the simplest of plant facilities, at last insofar as the basic extraction process is concerned. Of course, subsequent treatment of the recovered soda ash may call for a good sized plant as well as facilities to produce the caustic and, perhaps, recycle the hydrated lime if such is used, however, facilities for this purpose are auxiliary to those for extracting the sodium carbonate.

It is, therefore, the principal object of the present invention to provide a novel and improved solution mining process for recovering sodium carbonate from subterranean formations containing sodium bicarbonate.

A second objective of the invention is to provide a process of the type aforementioned wherein the yields far exceed those heretofore acheived through conventional aqueous extraction techniques.

Another object of the within described invention is the provision of a soda ash extraction process that eliminates the solubility inhibiting effect of the precipitated sodium bicarbonate.

Still another objectjive is to provide a process for the "in situ" extraction of soda ash found in mineral formations containing substantial amounts of sodium bicarbonate wherein the latter is partly or completely converted to sodium carbonate in a warm aqueous solution prior to its removal from the ground.

An additional objective is the provision of a solvent extraction process for mining sodium bicarbonate deposits that requires only minimal plant facilities and sometimes can make use of the sodium chloride often found in the same formation as a source of sodium ion for electrolytic production of the sodium hydoxide.

Further objects are to provide a process for solution mining of sodium bicarbonate mineral beds which is simple, versatile, inexpensive, efficient, safe and causes little damage to the environment.

Other objects will be in part apparent and in part pointed out specifically hereinafter in connection with the description of the drawings that follows, and in which.

Figure 1:
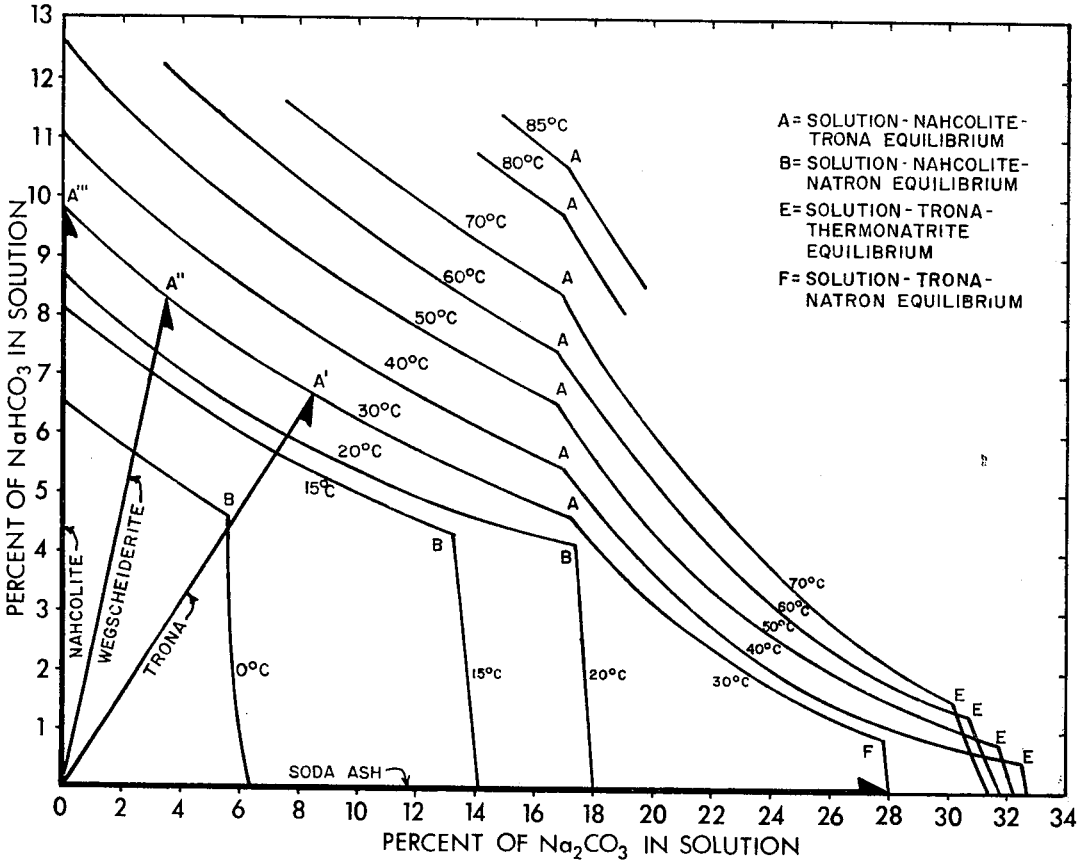
FIG. 1 is a graph delineating the percentage composition of both sodium carbonate and sodium bicarbonate in solution of nahcolite, wegscheiderite and trona at various temperatures.

A proper understanding of the present invention can best be had by first exploring the solubility characteristics of sodium carbonate, sodium bicarbonate and the naturally-occurring minerals containing the latter. Pure sodium bicarbonate has a relatively low solubility in water although it increases slightly with increases in temperature as evidenced by the following data:

TABLE 1

| Temp.[°C.] | 0 | 10 | 20 | 30 | 40 | 50 |
|---|---|---|---|---|---|---|
| %$NaHCO_3$ in soln. | 6.6 | 7.5 | 8.4 | 9.8 | 11 | 12.4 |

Pure nahcolite will, for instance, produce a saturated solution at 35°C. containing 10.3% by weight of $NaHCO_3$ or 11.5 g. $NaHCO_3$ per 100 g. $H_2O$. This quantity of $NaHCO_3$ can be shown equivalent to 7.2 g. $Na_2CO_3$ in accordance with the following equation:

$$2\ NaHCO_3 + \Delta \rightarrow Na_2CO_3 + CO_2 \uparrow + H_2O$$

Now, in contrast to nahcolite, pure soda ash has a much improved water solubility as shown in the table which follows:

TABLE 2

| Temp.[0°] | 0 | 10 | 20 | 30 | 35 | 50 | 70 |
|---|---|---|---|---|---|---|---|
| %$Na_2CO_3$ in soln. | 6.7 | 10.8 | 18 | 28 | 33 | 32.2 | 31.4 |

The solubility increases rapidly up to 35°C. reaching a maximum at the latter temperature before starting to fall off slightly. A saturated solution at 35°C. contains 33% $Na_2CO_3$ by weight or 49.2 g. $Na_2CO_3$ per 100 g. $H_2O$. As previously noted, only 11.5 g. of $NaHCO_3$ goes into solution at 35°C. and, when we reduce this to its equivalent in $Na_2CO_3$ (7.2 g.) it becomes apparent that nearly seven times as much $Na_2CO_3$ goes into solution at 35°C. than $NaHCO_3$.

Next, reference will be made to FIG. 1 of the drawing for an explanation of the somewhat complex solubility of the $Na_2CO_3$ — $NaHCO_3$ — $H_2O$ system because, with the exception of pure nahcolite deposits, the subterranean formations to which the present invention relates all contain such a mixture. Pure soda ash is shown along the abscissa to reach saturation at 30°C. with 28% $Na_2CO_3$ by weight in solution. Pure nahcolite will be found on the ordinate at point A''' to reach saturation at the same temperature containing only 9.8% $NaHCO_3$ by weight. These data correspond to that found in TABLES 1 and 2.

FIG. 1 also reveals the dissolving paths of the naturally-occurring double salts of sodium carbonate and sodium bicarbonate, namely, wegscheiderite and trona which, as previously mentioned, have the formulations $Na_2CO_3 \cdot 3NaHCO_3$ and $Na_2CO_3 \cdot NaHCO_3 \cdot 2H_2O$, respectively. The slope of the wegscheiderite and trona dissolving path lines corresponding to their respective gram molecular weights in the solution mixture. More specifically, the slope of the wegscheiderite dissolving path line is determined by the ratio of $Na_2CO_3$ to $3NaHCO_3$ or 106 to 252; whereas, that of trona is 106 to 84, there being only one molecule of $NaHCO_3$ for each molecule of $Na_2CO_3$ instead of three.

Now, following the dissolving path of the line labeled "TRONA" in FIG. 1, it can be seen that at point A' a saturated condition is reached at 30°C. wherein the solution contains about 8.4% $Na_2CO_3$ and about 6.7% $NaHCO_3$. However, nahcolite and not trona, is the stable solid phase between points A and A''' of the isotherm. Trona will therefore be decomposed and the solution composition changes following the downslope of the 30°C. curve until equilibrium is finally reached at point A with nahcolite and trona in solid phase and where the solution has a make-up of about 17.3% $Na_2CO_3$ and only about 4.6% $NaHCO_3$. A quantitative calculation indicates that 21.8 g. of trona per 100 g. of added water will have dissolved at point A'. At the equilibrium point A, the total amount of dissolved and decomposed trona is 50.7 g. in 100 g. of water, but as much as 12.4 g. of $NaHCO_3$ will have precipitated to coat the surrounding formation and seriously inhibit further dissolution of the $Na_2CO_3$. In other words, as additional solvent enters the cavity, it encounters a constantly changing mineral composition that appears at least to be getting richer in bicarbonate and leaner in carbonate due to the sealing off of the latter behind the sodium bicarbonate precipitate barrier. Eventually, the solvent will encounter a cavity lined with a virtually impenetrable barrier of sodium bicarbonate.

As evidenced by FIG. 1, this same phenomenon takes place at other temperatures than 30°C. in much the same way. Furthermore, both of the naturally-occurring minerals containing mixtures of sodium carbonate and sodium bicarbonate behave in a similar manner and each ends up at equilibrium having the same composition although their dissolving paths are entirely different. Nahcolite, of course, is the exception in that, for all practical purposes, it contains no sodium carbonate at all.

When nahcolite is dissolved in water it yields a saturated solution at 30°C. containing 9.8% $NaHCO_3$ by weight which, in the manner of the previous calculation, amounts to an equivalent of only 6.2% $Na_2CO_3$. At 30°C., a saturated solution of wegscheiderite prior to reaching equilibrium would contain about 8.3% $NaHCO_3$ and only about 3.5% $Na_2CO_3$. Trona is only slightly better in that the saturated solution at 30°C. prior to reaching equilibrium contains approximately 6.7% $NaHCO_3$ by weight and some 8.4% $Na_2CO_3$. The total percent of dissolved solids on an $Na_2CO_3$ equivalent basis after both the trona and wegscheiderite reach equilibrium is the same, namely, about 20% total dissolved solids.

A series of laboratory scale solubility studies carried out on Wyoming trona indicated that a weight loss of somewhere between 18.5 and 20.6 g. occurred in 100 g. of water at room temperature over a period of 12 to 15 hours. Theoretical calculations indicate that somewhere around 19 g. of trona should be present in the solution saturated with sodium bicarbonate, at the point where the trona dissolving path intersects the 20° isotherm (see FIG. 1). These test results, therefore, agree fairly well with the theoretical value.

Another series of solubility studies was made to determine whether the equilibrium condition could be achieved by providing more time. The trona samples were repeatedly immersed in fresh water at room temperature for 50 hours at a time and the resulting solutions were subsequently analyzed. According to FIG. 1, a solution composition of 17.4% $Na_2CO_3$ and 4.15% $NaHCO_3$ (equivalent to 20% $Na_2CO_3$) exists at point B where the solution is in equilibrium with nahcolite and natron at 20°C.

The analytical results show that the solution concentration decreased in the course of the experiments from about 17% $Na_2CO_3$-equivalent to eventually 11% $Na_2CO_3$-equivalent. This indicates quite clearly that the increase in time does not correspond with an increase in solution concentration, at least not in the long run. It was suspected that the increasingly lower solution concentration was caused by the presence of nahcolite which precipitated from trona. In accordance with the teaching of the instant invention, it was unexpectedly discovered that a material increase in the solubility of those naturally-occurring minerals containing a substantial proportion of sodium bicarbonate including nahcolite itself could be achieved by the simple, yet unobvious, expedient of removing the $NaHCO_3$ in solution by first converting same to $Na_2CO_3$. Caustic soda in aqueous solution proved to provide the best answer to the trona solubility problem in accordance with the following equation:

EQUATION 1

$$\text{trona: } \underset{226}{Na_2CO_3 \cdot NaCHO_3 \cdot 2H_2O} + \underset{40}{NaOH} = \underset{212}{2Na_2CO_3} + \underset{54}{3H_2O}$$

Verification of the suspected greatly improved solubility occurred when a third series of solubility tests were performed upon trona using an aqueous sodium hydroxide solution as the solvent instead of water alone. In most of the laboratory tests the samples were prepared by taking a large piece of coarse crystalline Wyoming trona ore, cutting a piece off with a hacksaw and drilling a small hole through the center for a suspension wire. The solvent, consisting of 200 g. of water alone or with varying amounts of sodium hydroxide, was placed in a glass jar. The sample was then suspended from a wire by the hole in the middle and immersed in the solvent so as to remain out of contact with the sides and bottom of the jar, the top of which was covered with a lid. All weighings were carried out on a triple beam balance accurate to 0.1 g.

Now, mention has already been made of the first group of comparison solubility tests in which between 18.5 and 20.6 g. of trona per 100 g. $H_2O$ dissolved in the aqueous solution in approximately fifteen hours at room temperature. The third series of tests is outlined below using an aqueous sodium hydroxide solvent under the same test conditions:

TEST 1

190.8 g. trona in 200 g. $H_2O$ + 8.6 g. NaOH at 20°C.

| Time [hours] | 0 | 1 | 9 |
|---|---|---|---|
| Wt. of Sample [g] | 190.8 | 162.6 | 143 |

-continued

Equivalent to 23.9 g. trona/100 g. $H_2O$ + 4.3 g. NaOH at 20°C.

TEST 2

101.6 g. trona in 200 g. $H_2O$ + 12.0 g. NaOH at 25°C.

| Time [hours] | 0 | 1 | 2 | 3 | 4 | 5 | 6 | 7 | 8 | 9 | 10 |
|---|---|---|---|---|---|---|---|---|---|---|---|
| Wt. of Sample [g] | 101.6 | 80.5 | 70 | 62 | 57 | 53.2 | 50.3 | 48.3 | 46.9 | 45.8 | 44.9 |

While the solution did not reach saturation after 10 hours, an equivalent of 28.4 g. trona/100 g. $H_2O$ + 6 g. NaOH dissolved at 25°C. Saturation occurs at 33.9 g. trona/100 g. $H_2O$ + 6 g. NaOH.

TEST 3

196.5 g. trona in 200 g. $H_2O$ + 20 g. NaOH at 50°C.

| Time [hours] | 0 | 1 | 2 | 3 | 4 |
|---|---|---|---|---|---|
| Wt. of Sample [g] | 196.5 | 135 | 115.6 | 107.5 | 102.6 |

Once again, the solution did not reach saturation after 4 hours, however, an equivalent of 46.95 g. trona/100 g. NaOH dissoled at 50°C. Saturation occurs at 57.6 g. trona/100 g. $H_2O$ + 10.2 g. NaOH.

Tests 1 and 2 performed at room temperature placed 23.9 g. and 28.4 g. of trona in solution, respectively, compared with a high of only 20.6 g. in the pure aqueous solution even after fifteen hours had elapsed. A five degree rise in temperature coupled with a substantial increase in sodium hydroxide concentration explains the better yield in Test 2 when compared with Test 1 although the beneficial effect of the sodium hydroxide in inhibiting the formation of the sodium bicarbonate precipitate is apparent in both. Comparing these with test 3, on the other hand, shows the considerable increase in yield occassioned by the higher temperature, even though the duration of the test was only 4 hours.

The fourth series of tests differed from the preceding ones in that the trona was crushed before placing it in the jar with the aqueous sodium hydroxide solvent. The jar was then placed in a water bath for a half hour and agitated periodically to accelerate the solvent action. Following the test, the remaining undissolved trona was separated from the brine by normal filtration methods.

TEST 4

90.2 g. trona in 200 g. $H_2O$ + 12.0 g.

NaOH at 25°C resulted in 67.7 g. trona going into solution in ½ hour

TEST 5

100.0 g. trona in 200 g. $H_2O$ + 16.4 g.

NaOH at 30°C. resulted in 88.1 g. trona going into solution in ½ hour

TEST 6

140 g. trona in 200 g. $H_2O$ + 21.2 g.

NaOH at 35°C. resulted in 114 g. trona going into solution in ½ hour

The results from Test 4 compare quite favorably with the theoretical saturated condition at 25°C. of 33.9 g. trona per 100 g. of added water. Test 5 is only slightly less favorable with an actual solubility at 30°C. of 44 g. trona per 100 g. of water added instead of 46.1 g. The remaining test of the series, Test 6 at 35°C., also gave excellent results in that some 57 g. of trona dissolved in 100 g. of added water instead of the 60.0 g. that would have gone into solution had it ended up saturated. All of this series of tests resulted in a near saturated condition and it becomes apparent that agitation and fracturing the subterranean formation should materially reduce the time it takes for the solvent action to approach a saturated condition. Furthermore, this series of tests shows the large amount of trona which will dissolve in the presence of a substantial amount of NaOH already in the solvent. Moreover, the trona dissolves without precipitating any nahcolite.

In the fourth series of tests the amount of NaOH in the solvent had been such that all the $NaHCO_3$ which can go into solution was converted into $Na_2CO_3$ in accordance with Equation 1. If the NaOH-concentration of the solvent is lowered, a smaller amount of $Na_2CO_3$ will form and the saturated solution will contain sodium bicarbonate also. Since it is to be expected that only a certain amount of $NaHCO_3$ can exist in solution when trona is present, another series of tests was carried out to determine just how much sodium bicarbonate is permissible.

The fifth test series was run at 30°C. over a period of 31 hours and involved treating solid pieces of trona. Note that the solvent contained sodium carbonate instead of sodium hydroxide. The sodium carbonate concentration is equivalent to the sodium hydroxide percentage figure which is shown for each test.

| | TEST 7 | TEST 8 | TEST 9 | TEST 10 | TEST 11 |
|---|---|---|---|---|---|
| g. solvent | 99.5 | 99.6 | 99.1 | 89.8 | 99.2 |
| %$Na_2CO_3$ in solvent | 6 | 9 | 12 | 15 | 18 |
| = %NaOH | 1.2 | 1.9 | 2.6 | 3.4 | 4.2 |
| trona weight loss [g] | 19.7 | 20 | 15.9 | 13.7 | 10.2 |

Upon termination of the tests it was observed that a layer of nahcolite, several millimeters thick, had formed on the surface of the trona samples in Tests 7 and 8. A thin film of nahcolite covered the trona sample in Test 9 while the trona specimens in Tests 10 and 11 did not produce any nahcolite at all. These results indicate that the concentration of 2.6% NaOH-equivalent in Test 9 is fairly close to the least possible NaOH concentration which will prevent the precipitation of nahcolite from trona.

Figure 3:
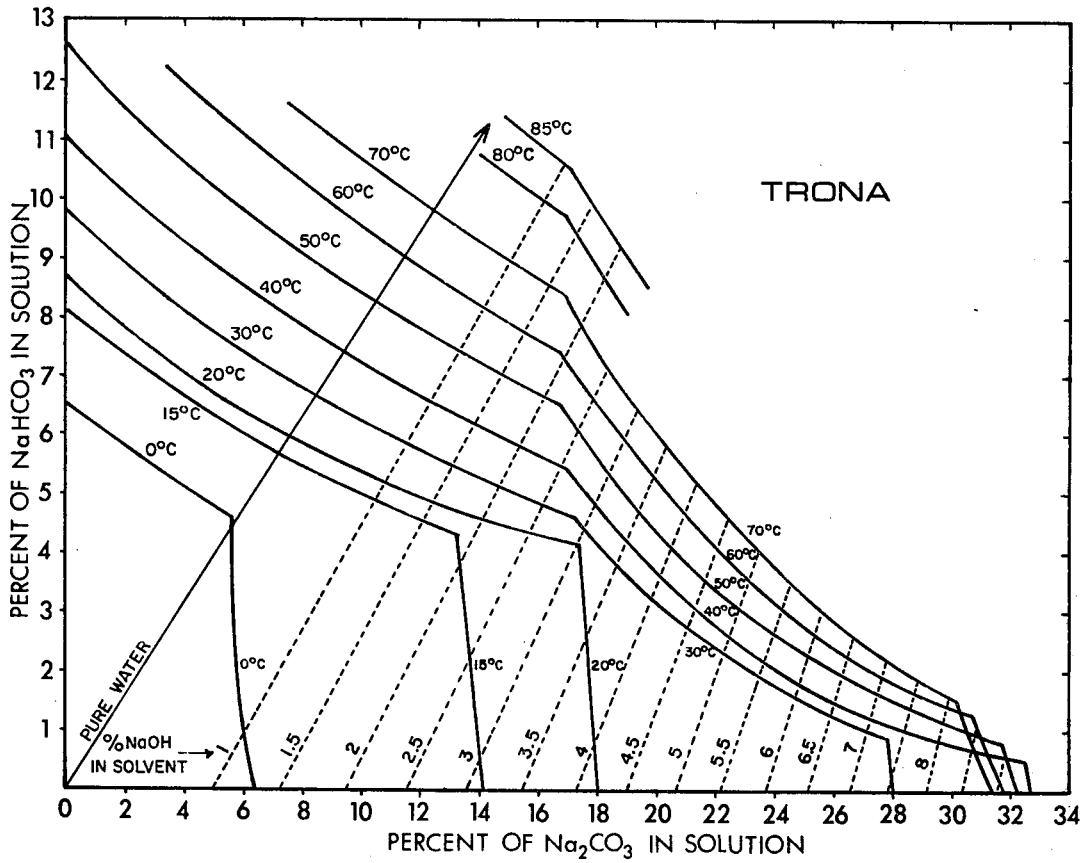
FIG. 3 is a graph like that of FIG. 1 to which has been added lines representing the dissolving paths of trona in aqueous sodium hydroxide solutions containing various concentrations of sodium hydroxide.

Next, with reference to FIG. 3 of the drawings, a comparison of these findings with the data shown graphically therein indicates that slightly less than 3% NaOH must be present in the solvent so that the dissolving path will first follow the abscissa and then move upwards to reach the solution-nahcolite-trona equilibrium point (point A in FIG. 1) at 30°C. A calculation shows the proper concentration to be 2.87% NaOH at 30°C. From the foregoing series of trona tests it becomes apparent that:

1. The solubility of trona is severly restricted when the solvent is pure water.
2. The solubility can be improved by adding as a minimum at least that small amount of NaOH to the solvent which is adequate to convert enough of the $NaHCO_3$ into $Na_2CO_3$ to prevent the precipitation of any appreciable quantity of nahcolite.
3. The maximum solubility, on the other hand, is achieved by adding a relatively large amount of NaOH, this being the amount that is necessary to convert into $Na_2CO_3$ all of the $NaHCO_3$ which can go into solution.

The following equations represent the reactions taking place when the remaining two sodium bicarbonate bearing minerals are dissolved in an aqueous sodium hydroxide solution, the equation for trona having previously been given in EQUATION 1:

EQUATION 2 wegscheiderite: $3NaHCO_3 . Na_2CO_3 + 3NaOH = 4Na_2CO_3 + 3H_2O$
358 120 424 54

EQUATION 3

Nahcolite: $NaHCO_3 + NaOH = Na_2CO_3 + H_2O$
84 40 106 18

It has already been mentioned that nahcolite precipitation from trona can be prevented by adding a specific minimum amount of NaOH to the water. The same applies to wegscheiderite also, except that more NaOH is required. The specific amounts are shown in the following tables:

TABLE 3

| Temp. | Minimum NaOH solvent concentration for trona g. NaOH/100 g. $H_2O$ | % NaOH | % $Na_2CO_3$ equivalent of saturated solution |
|---|---|---|---|
| 15°C. | 1.9 | 1.86 | 16 |
| 20°C. | 3.1 | 3.0 | 20 |
| 30°C. | 2.96 | 2.87 | 20.2 |
| 40°C. | 2.6 | 2.53 | 20.3 |
| 50°C. | 2.26 | 2.21 | 20.9 |
| 60°C. | 1.99 | 1.95 | 21.5 |
| 70°C. | 1.71 | 1.68 | 22.2 |
| 80°C. | 1.32 | 1.3 | 23.1 |

TABLE 4

| Temp. | Minimum NaOH solvent concentration for wegscheiderite g. NaOH/100 g. $H_2O$ | % NaOH | % $Na_2CO_3$ equivalent of saturated solution |
|---|---|---|---|
| 15°C. | 4.01 | 3.97 | 16 |
| 20°C. | 5.8 | 5.48 | 20 |
| 30°C. | 5.71 | 5.4 | 20.2 |
| 40°C. | 5.45 | 5.17 | 20.3 |
| 50°C. | 5.32 | 5.05 | 20.9 |
| 60°C. | 5.23 | 4.97 | 21.5 |
| 70°C. | 5.19 | 4.93 | 22.2 |
| 80°C. | 5.1 | 4.85 | 23.1 |

By converting all of the dissolved sodium bicarbonate from an ore body to sodium carbonate, the data relating to the latter in aqueous solution then becomes the system by which we can evaluate the potential maximum yield of a deposit. Data for such a system is found in the following tables:

TABLE 5

| Saturated $Na_2CO_3$ solutions from trona calculated per 100 g. $H_2O$ added | | | | | | | |
|---|---|---|---|---|---|---|---|
| Temp. | g.trona | + | g.NaOH | = | g.$Na_2CO_3$ | + | g.$H_2O$ | %$Na_2CO_3$ soln. |
| 15°C. | 18.1 | | 3.2 | | 17.0 | | 4.4 | 14.0 |
| 20°C. | 24.7 | | 4.4 | | 23.2 | | hl 5.9 | 18.0 |
| 25°C. | 33.9 | | 6.0 | | 31.8 | | 8.1 | 22.7 |
| 30°C. | 46.1 | | 8.2 | | 43.2 | | 11.0 | 28.0 |
| 35°C. | 60.0 | | 10.6 | | 56.3 | | 14.3 | 33.0 |
| 40°C. | 59 | | 10.5 | | 55.4 | | 14.0 | 32.7 |
| 50°C. | 57.6 | | 10.2 | | 54.0 | | 13.7 | 32.2 |

TABLE 6

| Saturated $Na_2CO_3$ solutions from wegscheiderite calculated per 100 g. $H_2O$ added | | | | | | | |
|---|---|---|---|---|---|---|---|
| Temp. | g.Wegscheiderite | + | g.NaOH | = | g.$Na_2CO_3$ | + | g.$H_2O$ | %$Na_2CO_3$ soln. |
| 15°C. | 14.0 | | 4.7 | | 16.6 | | 2.1 | 14.0 |
| 20°C. | 19.1 | | 6.4 | | 22.6 | | 2.9 | 18.0 |
| 25°C. | 25.8 | | 8.6 | | 30.5 | | 3.9 | 22.7 |
| 30°C. | 34.4 | | 11.5 | | 40.8 | | 5.2 | 28.0 |
| 35°C. | 44.4 | | 14.9 | | 52.6 | | 6.7 | 33.0 |
| 40°C. | 43.8 | | 14.7 | | 51.9 | | 6.7 | 32.7 |
| 50°C. | 42.6 | | 14.3 | | 50.5 | | 6.4 | 32.2 |

TABLE 7

Saturated $Na_2CO_3$ solutions from nahcolite calculated per 100 g. $H_2O$ added

| Temp. | g.nahcolite | + | g.NaOH | = | g.$Na_2CO_3$ | + | g.$H_2O$ | %$Na_2CO_3$ soln. |
|---|---|---|---|---|---|---|---|---|
| 15°C. | 13.3 | | 6.3 | | 16.8 | | 2.9 | 14.0 |
| 20°C. | 18.1 | | 8.6 | | 22.8 | | 3.9 | 18.0 |
| 25°C. | 24.5 | | 11.7 | | 30.9 | | 5.4 | 22.7 |
| 30°C. | 33.0 | | 15.7 | | 41.7 | | 7.1 | 28.0 |
| 35°C. | 42.6 | | 20.3 | | 53.7 | | 9.1 | 33.0 |
| 40°C. | 41.9 | | 20.0 | | 53.0 | | 9.0 | 32.7 |
| 50°C. | 41.0 | | 19.5 | | 51.7 | | 8.8 | 32.2 |

Figure 2:
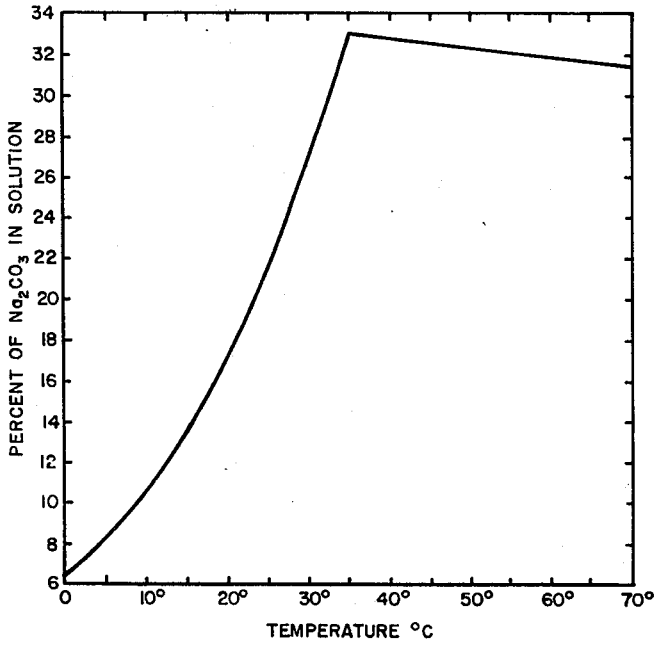
FIG. 2 is a temperature-solubility curve for soda ash solutions.

The values from the last column in each of the TABLES 5, 6 and 7 are, of course, identical as they should be and they have been represented graphically in the solubility curve of FIG. 2. This figure provides graphic emphasis of the greatly increased solubility as the temperature goes up to 35°C. before it begins to fall off once again, but much less rapidly. These tables also reveal the need for differing quantities of sodium hydroxide depending upon the particular mineral being treated and also its temperature. The maximum theoretical quantity of sodium hydroxide needed is, of course, that stoichiometrical amount necessary to convert all of the sodium bicarbonate present in the solution to sodium carbonate. Also, it might be wise to operate just below a saturated condition due to the salting out that would result if the temperature of the brine were to drop below that anticipated while bringing it to the surface. Another reason for operating under unsaturated conditions is because of the greatly decreased efficiency of the reaction as it nears completion together with the overly long reaction time; however, one could approach complete conversion under a given set of conditions, i.e., flow rate, etc., by increasing the NaOH concentration in the solvent until some reappeared at the surface unreacted in the brine.

The minimum and maximum yields which can be realized from sodium bicarbonate bearing ore bodies by addition of NaOH has already been given in Tables 3 through 7. There is, of course, no caustic soda minimum requirement when the deposit consists of nahcolite only. From an economic point of view it may be advantageous to choose operating conditions which exist somewhere in the broad area between the minimum-maximum boundaries. It is important, for instance, to consider the cost of producing the caustic soda on the one hand and the cost of evaporating water on the other.

Figure 4:
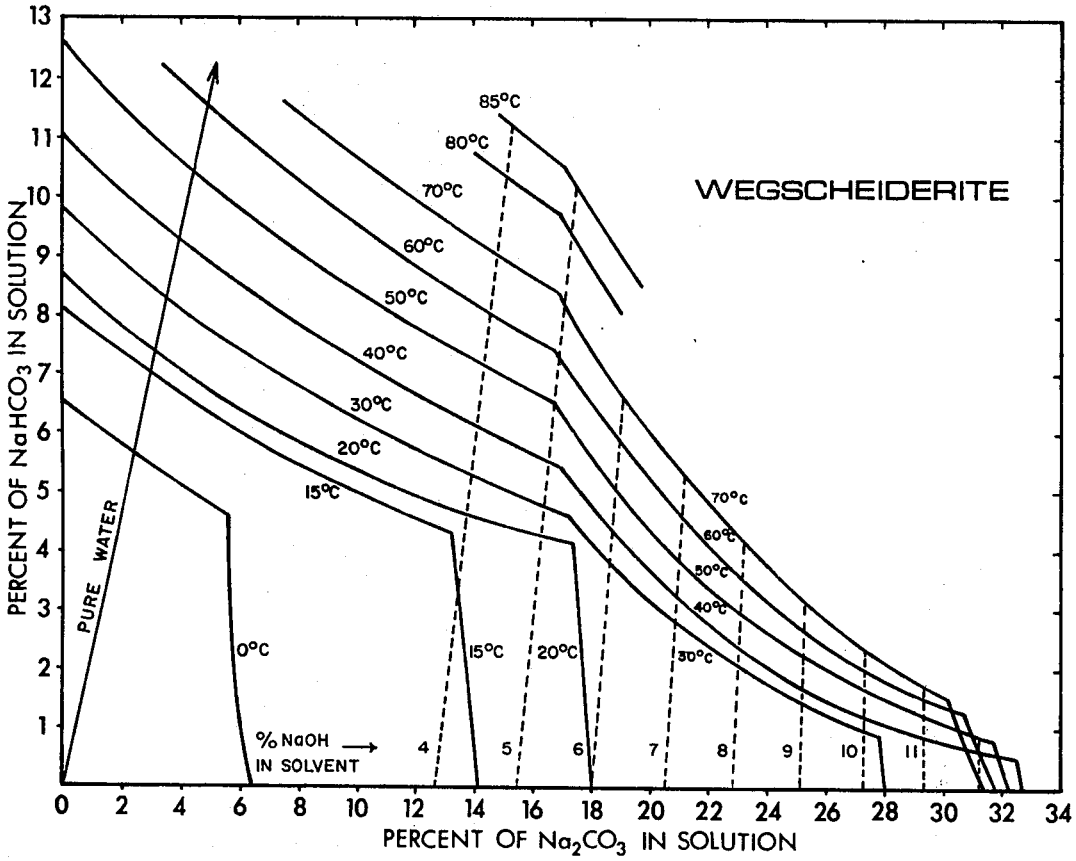
FIG. 4 is a graph like that of FIG. 3 except that the added dissolving path lines are those of wegscheiderite in various aqueous sodium hydroxide solutions rather than trona.
Figure 5:
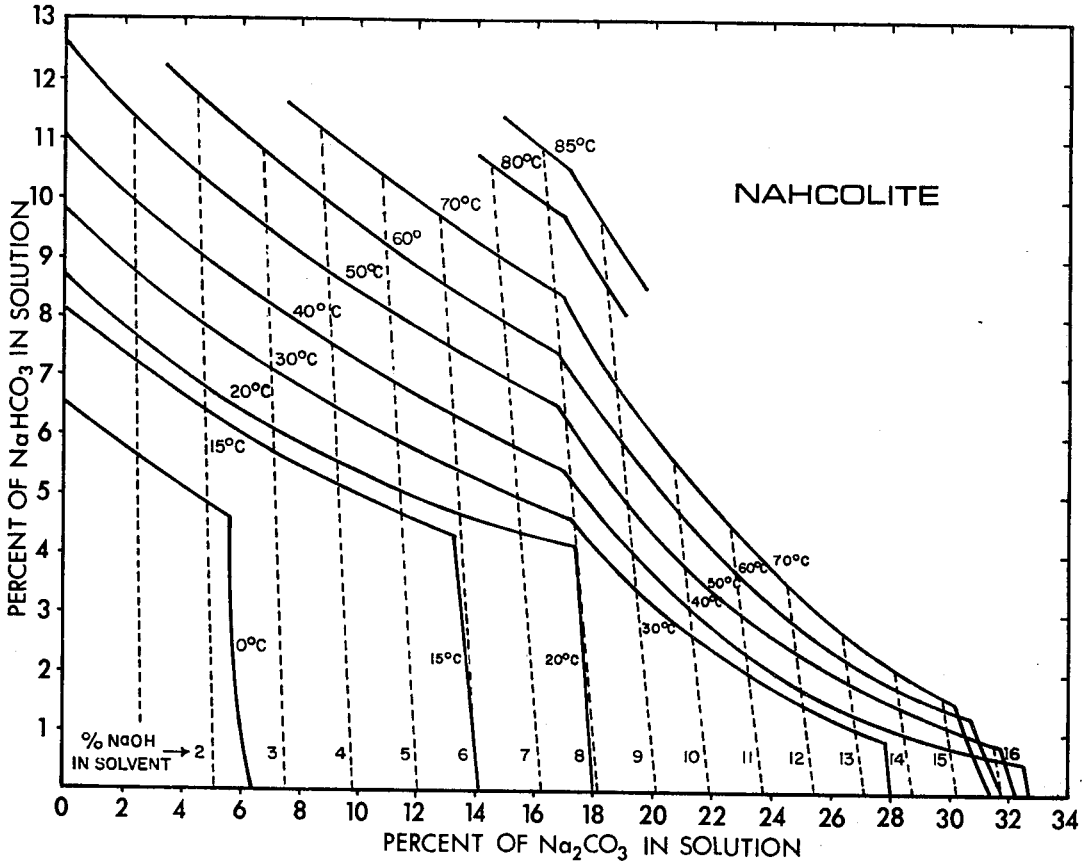
FIG. 5 is a graph like those of FIGS. 3 and 4 except that the added dissolving path lines are those of nahcolite rather than trona and wegscheiderite; and, FIG. 6 is a graph showing the net yield of sodium carbonate at 40°C. from the three sodium-bicarbonate-bearing minerals at various aqueous sodium hydroxide solvent concentrations.

FIGS. 3, 4 and 5 have been prepared for determining the dissolved solid concentration of solutions from trona, wegscheiderite and nahcolite as a function of the NaOH solvent concentration at different temperatures. For instance, if trona is treated with a solvent containing 5% NaOH and reaching saturation at 50°C., the solution concentration will be 22.8% $Na_2CO_3$ and 3.05% $NaHCO_3$. This is equivalent to 24.7% $Na_2CO_3$. It can also be seen in FIG. 3 that a 2% NaOH solvent will produce a nahcolite precipitate at temperatures below 60°C., but not at 60° or above.

The sixth series of tests were made under the same testing conditions as the fourth series except that naturally-occurring nahcolite from a shale deposit containing same in Colorado was used in one test and naturally-occurring wegscheiderite in another.

TEST 12

133.3 g. nahcolite in 200 g. $H_2O$ + 40.6 g. NaOH at 35°C. resulted in 73.3 g. nahcolite going into solution with periodic agitation over a fifty minute period.

This amount of sodium hydroxide should, theoretically, convert 85.2 g. of the nahcolite to sodium bicarbonate which would then go into solution. The yield, therefore, was 86% which is acceptable although not nearly as good as was realized with the trona. The relatively poorer results can, in all probability, be accounted for by the character of the naturally-occurring formation which, in addition to the nahcolite, contained a great deal of organic matter, so much in fact that the resulting solution was dark brown to almost black in color.

The following test was run on a small sample of wegscheiderite from a formation in Utah.

TEST 13

18.2 g. of wegscheiderite in 30 g. $H_2O$ + 4.5 g. NaOH at 35°C. yielded a residue of 6.4 g. following periodic agitation for thirty minutes.

Theoretically, 13.3 g. of Wegscheiderite should have gone into solution and the 11.8 g. that did represent a yield of 89% which is quite satisfactory.

Next, with brief reference once again to the graphs forming the subject matter of FIGS. 2, 3, 4 and 5, it is obvious that the solubility of each of the three naturally-occurring sodium bicarbonate-bearing minerals is substantially increased by converting some or all of the sodium bicarbonate in the solution to sodium carbonate through the addition of sodium hydroxide to the solvent. It is also apparent that the solubility characteristics of all three minerals in an aqueous sodium hydroxide solution is substantially increased when the temperature is raised. The only exception to this rule exists when the maximum amount of NaOH is used which is shown in Tables 5, 6 and 7. These solutions reach a solubility maximum at 35°C. and raising the temperature above 35°C. results in some loss in solubility. This loss, however, is quite insignificant when one considers that the dissolving process is tremendously accelerated at higher temperatures.

Under actual minefield operating conditions one is free to choose a suitable and economic operating temperature as well as a practical NaOH solvent concentration within the indicated boundaries. However, it is mandatory that precipitation be prevented while the brine is pumped to the surface. This can be done by taking measures which eliminate a temperature drop in the production well. Another possibility is the dilution of brine with fresh water at the bottom of the withdrawal pipe. In a different way yet, the problem can be solved by producing a slightly undersaturated solution.

A question of importance to the solution miner is the problem of the heat balance. The solvent is injected into the cavity at a certain temperature and may leave the cavity at the same temperature. It is more likely though that the temperature of the exiting solution is either higher or lower. This depends upon depth, geothermal gradient, heat flow to or from the adjacent ground and upon the mineral which is being dissolved. Trona for instance will go into solution endothermically in pure water.

Contrary to what was expected, tests revealed that the dissolution of sodium bicarbonate-bearing minerals in an aqueous sodium hydroxide solution was exothermic rather than endothermic. While the dissolution of sodium hydroxide in water was known to be highly exothermic, once such dissolution was complete, the remaining step of dissolving the sodium bicarbonate-bearing ore in the aqueous sodium hydroxide solution thus formed was expected to be endothermic.

Much has already been said concerning the desirability of closely matching the maximum amount of available sodium hydroxide in the solvent to the amount of sodium bicarbonate in the solution. Further evidence of the need for careful control in this area becomes apparent when one examines the results of TEST 15 reported below:

TEST 15

The solvent was prepared by first dissolving sodium hydroxide in 100 g. of water. The sodium hydroxide was added in amounts having a known percentage of the stoichiometrical amount (10.6 g.) necessary to convert all the sodium carbonate present in solution to sodium carbonate. An excess quantity of coarsely ground trona was then placed in the solvent maintained at 35°C. Each sample was thoroughly agitated during the test period of 15 minutes. The results are shown in the following table:

Trona in 100 g. $H_2O$ + (x) g. NaOH at 35°C.

| g. NaOH/100 g. $H_2O$ | 0 | 2.1 | 5.3 | 8.5 | 9.5 | 10.6 | 11.1 | 12.7 |
|---|---|---|---|---|---|---|---|---|
| g. trona in soln. | 33 | 33 | 38 | 49 | 53 | 57 | 54 | 51 |

TEST 14

10.6 g. NaOH was dissolved in 100 g. $H_2O$ and allowed to cool to 70°F; whereupon, 50 g. of crushed trona was added and stirred for 2 minutes. The temperature of the solution was found to be 77°F.

The results of the above dissolution test clearly demonstrate the exothermic reaction that takes place when the sodium bicarbonate-bearing ores are dissolved in an aqueous sodium hydroxide solution. This means, of couse, that a most advantageous, yet completely unexpected, benefit has accrued over solution mining of these same minerals with water alone as the solvent. The exothermic reaction that results generates heat and this is of importance in maximizing the yield.

Here again, several factors must be taken into consideration. First of all, the simple dissolution of the sodium hydroxide in water is exothermic and may well be sufficient all by itself to supply the needed heat for prewarming the solvent; especially in a concentrated solution. Secondly, some of these subterranean formations are deep enough underground (3000 ft. or so) that they are already quite warm. Next, the exothermic reaction between the caustic soda and sodium bicarbonate can be relied upon for some additional heat. Finally, the duration of the reaction, the character of the formation and the length of time it takes to bring the brine to the surface will all influence the heat losses. Accordingly, adjustments in the temperature of the solvent, the concentration of the sodium hydroxide therein, the duration of the reaction and other controllable parameters will, undoubtedly, have to be monitored and changed from time to time in order to achieve optimum results.

The sample dissolving in pure water produced a substantial nahcolite precipitate. This simple experiment demonstrates quite clearly the potential gains of the caustic soda additive as well as the adverse effect that an excess has upon the dissolution of the sample.

Figure 6:
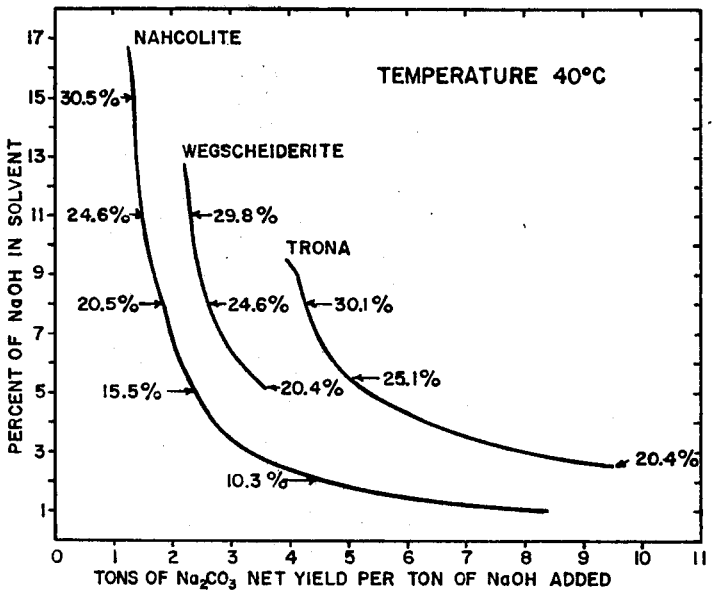

Finally with reference to FIG. 6, it can be seen that trona is the most desirable of all the three sodium bicarbonate minerals from an economic point of view. In order to produce a saturated solution at 40°C. containing the equivalent of 20.4% $Na_2CO_3$, the net yield per ton of NaOH used is 9.5 tons of soda ash from trona, 3.6 tons from wegscheiderite and 1.85 tons from nahcolite.

What is claimed is:

1. In a process for the solution mining of subterranean trona deposits wherein a portion of said deposit is dissolved in an aqueous solution containing a sufficient concentration of sodium hydroxide to prevent the sodium bicarbonate concentration in the brine from reaching a saturated condition when nahcolite alone is in the stable solid phase, the improvement which comprises limiting the maximum sodium hydroxide concentration to less than 3%.

2. The improvement as set forth in claim 1 in which the sodium hydroxide concentration in the solvent is not less than approximately 1%.

3. The improvement as set forth in claim 1 wherein the maximum sodium hydroxide concentration in the solvent is selected so as to maintain the sodium bicarbonate concentration in the saturated solution at between approximately 0.5 and 2%.

* * * * *